US011571095B2

(12) United States Patent
Conrad

(10) Patent No.: US 11,571,095 B2
(45) **Date of Patent: *Feb. 7, 2023**

(54) CYCLONIC AIR TREATMENT APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 763 days.

This patent is subject to a terminal disclaimer.

(21) Appl. No.: 16/549,341

(22) Filed: Aug. 23, 2019

(65) Prior Publication Data

US 2019/0374079 A1 Dec. 12, 2019

Related U.S. Application Data

(63) Continuation of application No. 16/022,845, filed on Jun. 29, 2018, now Pat. No. 10,433,686, which is a (Continued)

(30) Foreign Application Priority Data

Aug. 29, 2007 (CA) ..... CA 2599303
Mar. 11, 2009 (CA) ..... CA 2658005

(51) Int. Cl.
*A47L 9/10* (2006.01)
*A47L 5/22* (2006.01)
(Continued)

(52) U.S. Cl.
CPC ..... *A47L 5/225* (2013.01); *A47L 5/24* (2013.01); *A47L 5/36* (2013.01); *A47L 9/1625* (2013.01);
(Continued)

(58) Field of Classification Search
CPC ... A47L 5/225; A47L 5/24; A47L 5/36; A47L 9/1625; A47L 9/1641
(Continued)

(56) References Cited

U.S. PATENT DOCUMENTS 6,171,356 B1 1/2001 Twerdun
6,782,585 B1 8/2004 Conrad et al.
(Continued)

FOREIGN PATENT DOCUMENTS

CA 2658005 A1 9/2010
CA 2658014 A1 9/2010
(Continued)

OTHER PUBLICATIONS

English machine translation of DE112010001135, published on Aug. 2, 2012.
(Continued)

*Primary Examiner* — Joseph J Hail
*Assistant Examiner* — Shantese L McDonald
(74) *Attorney, Agent, or Firm* — Philip C. Mendes da Costa; Bereskin & Parr LLP/S.E.N.C.R.L., s.r.l.

(57) ABSTRACT

An apparatus having a first cyclonic stage having a dirt collection chamber external thereto wherein the cyclone and the dirt chamber are concurrently openable. A second cyclonic stage is downstream from the first cyclonic stage, a pre-motor filter is downstream from the second cyclonic stage and a suction motor is downstream from the pre-motor filter wherein the suction motor axis of rotation extends through the pre-motor filter chamber and the second cyclonic stage.

14 Claims, 10 Drawing Sheets

Related U.S. Application Data continuation of application No. 15/406,434, filed on Jan. 13, 2017, now Pat. No. 10,561,286, which is a continuation of application No. 14/470,342, filed on Aug. 27, 2014, now abandoned, which is a continuation of application No. 12/721,128, filed on Mar. 10, 2010, now Pat. No. 8,950,039, which is a continuation-in-part of application No. 12/675,512, filed as application No. PCT/CA2008/001531 on Aug. 28, 2008, now abandoned, said application No. 12/721,128 is a continuation-in-part of application No. 12/675,540, filed as application No. PCT/CA2008/001530 on Aug. 28, 2008, now Pat. No. 9,027,201, said application No. 12/721,128 is a continuation-in-part of application No. 12/675,636, filed as application No. PCT/CA2008/001519 on Aug. 27, 2008, now abandoned.

(51) Int. Cl.

| | |
|---|---|
| ***A47L 5/24*** | (2006.01) |
| ***A47L 5/36*** | (2006.01) |
| ***A47L 9/16*** | (2006.01) |
| ***A47L 9/32*** | (2006.01) |

(52) U.S. Cl.

CPC ..... *A47L 9/1641* (2013.01); *A47L 9/1666* (2013.01); *A47L 9/1683* (2013.01); *A47L 9/327* (2013.01)

(58) Field of Classification Search

USPC ..... 15/347, 344, 327.2, 353

See application file for complete search history.

(56) References Cited

U.S. PATENT DOCUMENTS

| | | | | |
|---|---|---|---|---|
| 7,335,242 | B2 | 2/2008 | Oh | |
| 7,645,309 | B2 | 1/2010 | Jeong et al. | |
| 7,887,612 | B2 | 2/2011 | Conrad | |
| 7,941,895 | B2 | 5/2011 | Conrad | |
| 8,100,999 | B2 | 1/2012 | Ashbee et al. | |
| 8,359,705 | B2 | 1/2013 | Conrad | |
| 8,950,039 | B2 | 2/2015 | Conrad | |
| 10,433,686 | B2 | 10/2019 | Conrad | |
| 2004/0163201 | A1* | 8/2004 | Murphy | A47L 9/1666 15/327.2 |
| 2005/0198769 | A1 | 9/2005 | Lee et al. | |
| 2005/0252179 | A1 | 11/2005 | Oh et al. | |
| 2006/0123590 | A1 | 6/2006 | Fester et al. | |
| 2006/0156699 | A1 | 7/2006 | Kim | |
| 2006/0168923 | A1* | 8/2006 | Lee | A47L 9/1625 55/345 |
| 2007/0079585 | A1 | 4/2007 | Oh et al. | |
| 2007/0289267 | A1 | 12/2007 | Makarov et al. | |
| 2008/0047091 | A1 | 2/2008 | Nguyen | |
| 2008/0172995 | A1 | 7/2008 | Conrad | |
| 2008/0178416 | A1 | 7/2008 | Conrad | |
| 2008/0178420 | A1 | 7/2008 | Conrad | |
| 2008/0184681 | A1* | 8/2008 | Oh | A47L 9/1641 55/345 |
| 2008/0190080 | A1 | 8/2008 | Oh et al. | |
| 2009/0282639 | A1 | 11/2009 | Dyson et al. | |
| 2010/0175217 | A1 | 7/2010 | Conrad | |
| 2010/0229322 | A1 | 9/2010 | Conrad | |
| 2011/0219570 | A1 | 9/2011 | Conrad | |
| 2014/0237768 | A1 | 8/2014 | Conrad | |
| 2016/0367094 | A1 | 12/2016 | Conrad | |

FOREIGN PATENT DOCUMENTS

| | | | |
|---|---|---|---|
| CA | 2659212 | A1 | 9/2010 |
| CN | 2524655 | Y | 12/2002 |
| CN | 100998484 | A | 7/2007 |
| CN | 101015436 | A | 8/2007 |
| CN | 101108106 | A | 1/2008 |
| DE | 112010001135 | T5 | 8/2012 |
| WO | 2009026709 | A1 | 3/2009 |
| WO | 2010102396 | A1 | 9/2010 |

OTHER PUBLICATIONS

English machine translation of CN101108106, published on Jan. 23, 2008.

English machine translation of CN101015436, published on Aug. 15, 2007.

English machine translation of CN100998484, published on Jul. 18, 2007.

English machine translation of CN2524655, published on Dec. 11, 2002.

* cited by examiner

CYCLONIC AIR TREATMENT APPARATUS

CROSS REFERENCE TO RELATED APPLICATIONS

This application is a continuation of U.S. patent application Ser. No. 16/022,845, filed on Jun. 29, 2018, which is allowed, which itself is a continuation of U.S. patent application Ser. No. 15/406,434, filed on Jan. 13, 2017, which is pending, which itself is a continuation of U.S. patent application Ser. No. 14/470,342, filed on Aug. 27, 2014, which is abandoned and which itself is a continuation of U.S. patent application Ser. No. 12/721,128, filed on Mar. 10, 2010, which claimed priority from Canadian Patent Application no. 2,658,005 and issued as U.S. Pat. No. 8,950,039, which itself is (a) a continuation-in-part of U.S. patent application Ser. No. 12/675,512 filed Feb. 26, 2010 entitled CYCLONIC SURFACE CLEANING APPARATUS WITH A SPACED APART IMPINGEMENT SURFACE, which is abandoned and which was a national phase entry of PCT/CA2008/001531 which claimed priority from CA2,599,303, and is (b) a continuation-in-part of U.S. patent application Ser. No. 12/675,540 filed on Feb. 26, 2010 entitled CYCLONIC SURFACE CLEANING APPARATUS WITH EXTERNALLY POSITIONED DIRT CHAMBER, now U.S. Pat. No. 9,027,201, and which was a national phase entry of PCT/CA2008/001530 which claimed priority from CA2,599,303; and, is (c) a continuation-in-part of U.S. patent application Ser. No. 12/675,636 filed Feb. 26, 2010 entitled CYCLONIC SURFACE CLEANING APPARATUS WITH SEQUENTIAL FILTRATION MEMBERS which is abandoned and which was a national phase entry of PCT/CA2008/001519 which claimed priority from CA2,599,303 the entirety of which are hereby incorporated by reference.

FIELD

The specification relates to surface cleaning apparatus such as vacuum cleaners. In a preferred embodiment, the specification relates to cyclonic hand vacuum cleaners.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims According to one broad aspect, a surface cleaning apparatus and, preferably a cyclonic hand vacuum cleaner and/or a surface cleaning unit that is removably mounted to an upright support structure that is pivotally mounted to a cleaning head is provided wherein at least part, and preferably a substantial portion, of the air flow path between components of the surface cleaning apparatus is linear. Accordingly, one or more components of the vacuum cleaner may be arranged such that the air outlet of an upstream component faces the air inlet of a downstream component. In a preferred embodiment, the outlet from a cyclone is oriented such that the air may travel generally linearly to the inlet of a suction motor. This may be achieved by orienting the axis of a cyclone such that the cyclone axis is generally parallel to the axis of the suction motor. If the hand vacuum cleaner has more than one cyclonic stage, then the outlet of the last pre-motor cyclone or cyclones is preferably oriented such that the air may travel generally linearly to the inlet of a suction motor. It will be appreciated that one or more pre-motor filters may be positioned between the cyclone outlet and the suction motor inlet. Preferably, the air flow through the pre-motor filter or filters is generally linear. It will be appreciated that the air outlet of other components (e.g., a cyclone, filter or suction motor) may also be oriented such that the air may travel generally linearly to the inlet of the next downstream component (e.g., a cyclone, filter or suction motor).

An advantage of this design is that the backpressure in the airflow path through the hand vacuum cleaner may be reduced. Accordingly, the airflow rate through the hand vacuum cleaner may be increased without increasing the size (and weight) of the suction motor. Alternately, or in addition, a smaller motor may be used with decreasing the airflow rate through the hand vacuum cleaner.

Accordingly, the hand vacuum cleaner may comprise a front end, a rear end andn air flow passage extending from a dirty air inlet to a clean air outlet. A first cyclone unit is positioned in the air flow passage. The first cyclone unit may comprise at least one cyclone comprising a cyclone inlet and a cyclone outlet, and at least one dirt collection chamber. A suction motor is positioned in the air flow passage preferably downstream from the first cyclone unit. The air flow passage may include a generally linear air flow path from the cyclone outlet to the suction motor.

In some examples, the vacuum cleaner further comprises a pre-motor filter, wherein the first cyclone unit, the pre-motor filter and the suction motor are arranged linearly. Accordingly, the inlets and the outlets may face each other so that the air travels generally in a straight line between the components. It will be appreciated that the components may be arranged along a straight line.

In some examples, the at least one cyclone has a cyclone axis extending longitudinally through the at least one cyclone, the hand vacuum cleaner has an axis extending from the front end to the rear end, and the cyclone axis is generally parallel to the axis of the hand vacuum cleaner. The cyclone axis may be parallel to an axis extending through the suction motor (e.g., co axial or parallel to the shaft on which a suction fan rotates.

In some examples, the at least one cyclone has a cyclone axis extending longitudinally through the at least one cyclone, the suction motor has a motor axis extending generally parallel to the axis of rotation of a suction fan and the cyclone axis is generally parallel to the motor axis.

In some examples, the suction motor is positioned rearward of the first cyclone unit.

In some examples, the first cyclone unit is positioned at the front end of the hand vacuum cleaner.

In some examples, the dirt collection chamber has an openable door provided at a front end of the first cyclone unit.

In some examples, the at least one cyclone has a cyclone front end, and a cyclone rear end, and the cyclone air inlet and the cyclone air outlet are at the same end of the at least one cyclone. In some examples, the cyclone air inlet and the cyclone air outlet are at the cyclone rear end. The cyclone may have a dirt outlet and the dirt out is preferably positioned at an end opposed to the end having the cyclone air inlet. Preferably, the cyclone dirt outlet is at the cyclone front end.

In some examples, the cyclone front end is proximate the front end of the hand vacuum cleaner, the cyclone front end has a dirt outlet, and a separation plate is mounted in facing relation to the dirt outlet.

In some examples, the dirt collection chamber has an openable door provided at the cyclone front end and the separation plate is mounted to the door. The door may alternately or in addition be removable.

In some examples, the at least one dirt collection chamber is openable when mounted to the hand vacuum cleaner.

In some examples, the vacuum cleaner further comprises a suction motor housing. The suction motor is positioned in the suction motor housing and the first cyclone unit is removably mounted to the suction motor housing.

In some examples, the vacuum cleaner further comprises a pre-motor filter positioned facing the cyclone air outlet and having a pre-motor filter air inlet and a pre-motor filter air outlet. The suction motor has a motor axis extending generally parallel to the axis of rotation of a suction fan and the pre-motor filter air inlet and the pre-motor air outlet each define a plane that is generally transverse to the motor axis.

In some examples, the vacuum cleaner further comprises a post motor filter having a post motor filter air inlet and a post motor filter air outlet, the suction motor has a motor axis extending generally parallel to the axis of rotation of a suction fan, and the post motor filter air inlet and the post motor air outlet are generally transverse to the motor axis.

In some examples, the vacuum cleaner further comprises a pre-motor filter having a pre-motor filter air inlet and a pre-motor filter air outlet and a post motor filter having a post motor filter air inlet and a post motor filter air outlet, and some, and preferably all, of the pre-motor filter air inlet, the pre-motor air outlet, the post motor filter air inlet and the post motor air outlet are aligned.

In some examples, the vacuum cleaner further comprises a post motor filter positioned downstream from the suction motor and comprising an air outlet at the rear end of the hand vacuum cleaner.

In some examples, the vacuum cleaner further comprises the first cyclone unit comprises a single cyclone and a single dirt collection chamber. In other examples, the vacuum cleaner further comprises a second cyclone unit downstream from the first cyclone unit. In such examples, the second cyclone unit may have a second cyclone air inlet having a direction of flow and a second cyclone air outlet having a direction of flow and the direction of flow through the second cyclone air inlet and/or the second cyclone air outlet may be in the same direction as the direction of air flow through the cyclone outlet.

According to another broad aspect, a surface cleaning apparatus is provided. The surface cleaning apparatus comprises an air flow passage extending from a dirty air inlet to a clean air outlet. The surface cleaning apparatus further comprises a floor cleaning unit comprising a surface cleaning head and a handle drivingly connected thereto. A surface cleaning unit is removably mounted to the floor cleaning unit. The surface cleaning unit comprises a first cyclone unit positioned in the air flow passage. The first cyclone unit comprises at least one cyclone comprising a cyclone inlet and a cyclone outlet and at least one dirt collection chamber. A suction motor is positioned in the air flow passage downstream from the first cyclone unit. The air flow passage includes a generally linear air flow path from the cyclone outlet to the suction motor.

In some examples, the surface cleaning unit is operable when removed from the floor cleaning unit.

In some examples, the air flow passage comprises a portion extending from the surface cleaning head to the surface cleaning unit and the portion comprises a flexible conduit.

In some examples, the first cyclone unit is positioned above the suction motor when the surface cleaning unit is mounted to the floor cleaning unit.

In some examples, the first cyclone unit has a portion that is openable or removable and the portion is located at an upper end of the first cyclone unit.

In some examples, the surface cleaning unit is removably mounted to the handle.

According to another broad aspect, an upright surface cleaning apparatus is provided. The upright surface cleaning apparatus comprises an air flow passage extending from a dirty air inlet to a clean air outlet. A floor cleaning unit is provided which comprises a surface cleaning head and a handle drivingly connected thereto. A first cyclone unit is supported by the handle and is in the air flow passage. The first cyclone unit comprises at least one cyclone comprising a cyclone inlet and a cyclone outlet and at least one dirt collection chamber. A suction motor is supported by the handle below the first cyclone unit.

In some examples, the cyclone unit is mounted to the handle.

In some examples, the air flow passage includes a generally linear air flow path from the cyclone outlet to the suction motor.

It will be appreciated that the vacuum cleaner may incorporate one or more of the features of each of these examples.

DRAWINGS

In the detailed description, reference will be made to the following drawings, in which.

DESCRIPTION OF VARIOUS EXAMPLES

Figure 1:
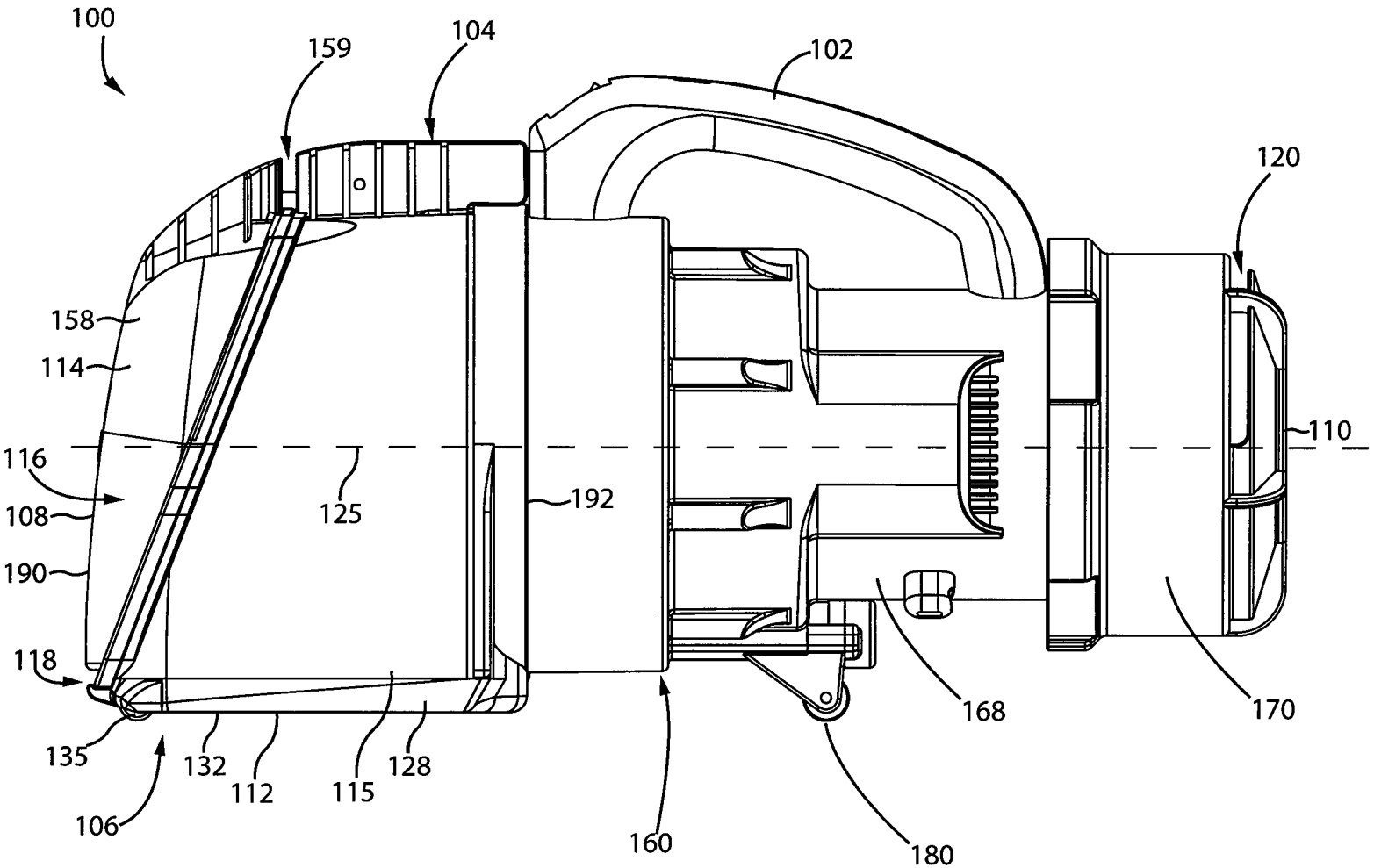
FIG. 1 is a side plan view of an example of a surface cleaning unit.
Figure 2:
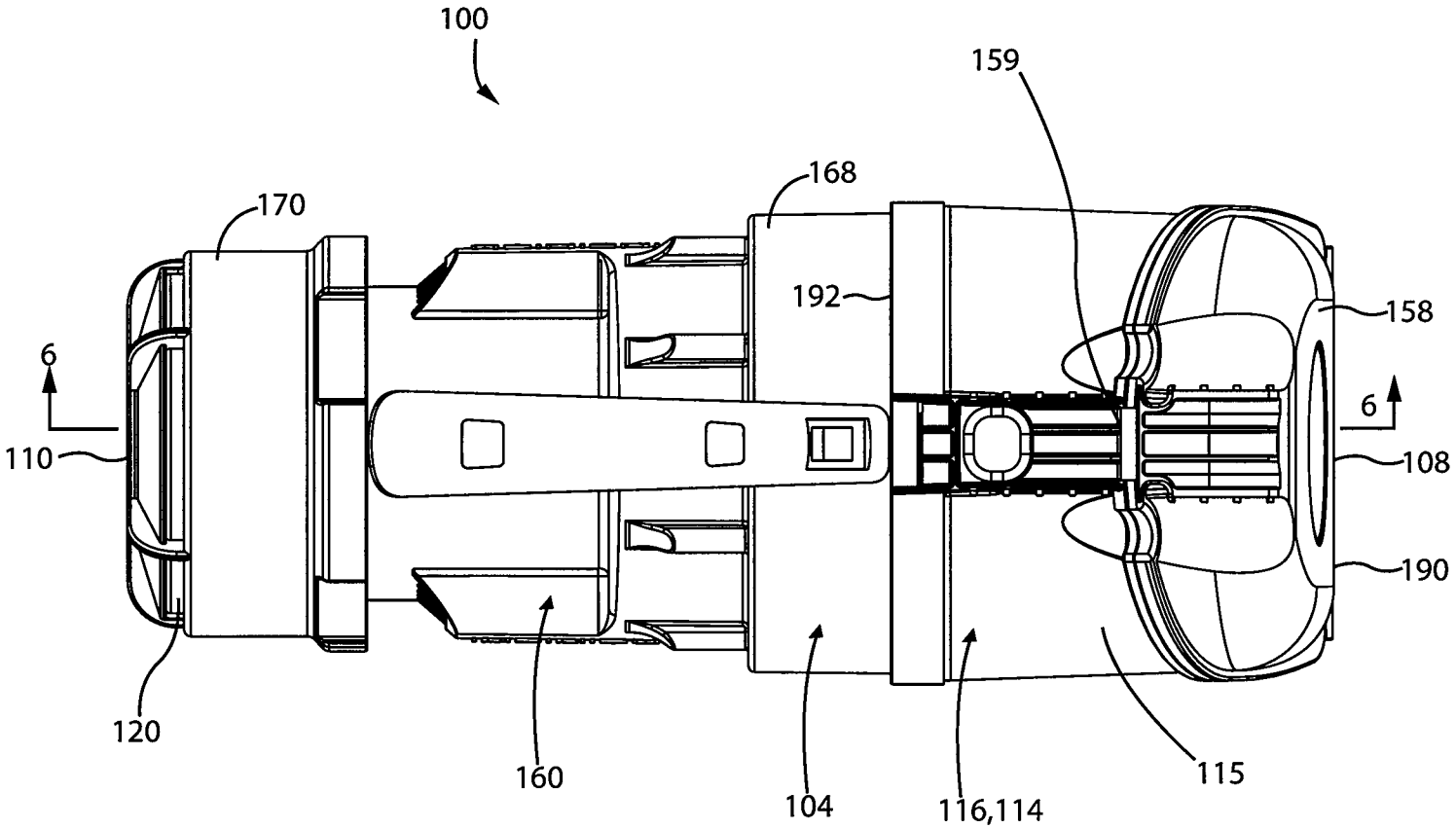
FIG. 2 is a top plan view of the surface cleaning unit of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

In the drawings attached hereto, the hand vacuum cleaner is exemplified as comprising one or two cyclonic stages. It will be appreciated that the vacuum cleaner 100 may be of various configurations (e.g., different positioning of the cyclonic stages and the suction motor and differing cyclonic stages that may comprise one or more cyclones and one or more filters).

Referring to FIGS. 1 to 7, a first example of a surface cleaning unit 100 is shown. In the embodiment shown, the surface cleaning unit 100 (also referred to herein as vacuum cleaner 100 or cleaner 100) is usable as a vacuum cleaner 100, and more particularly a hand vacuum cleaner 100. The vacuum cleaner 100 is movable along a surface to be cleaned by gripping and maneuvering handle 102. The vacuum cleaner includes an upper portion 104, a lower portion 106, a front end 108, and a rear end 110. A longitudinal axis 125 of the vacuum cleaner 100 extends between the front end 108 and the rear end 110. In the example shown, handle 102 is provided at the upper portion 104. In alternate examples, handle 102 may be provided elsewhere on the vacuum cleaner 100, for example at the rear 110 and may be of any design.

In the example shown, the vacuum cleaner 100 comprises a nozzle 112 and a cyclone unit 114, which together preferably form a surface cleaning head 116 of the vacuum cleaner 100. In the example shown, the surface cleaning head 116 is preferably provided at the front end 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear 110 of the cleaner 100.

Cyclone unit 114 is provided in the airflow passage, downstream of the dirty air inlet 118. Cyclone unit 116 has a front end 190, and a rear end 192. In the example shown, the cyclone unit 114 is a one piece assembly comprising one cyclone 122, and one dirt collection chamber 124, which are integrally formed. In alternate examples, as will be described hereinbelow with respect to FIG. 8, the cyclone unit 114 may include more than one cyclonic stage, wherein each cyclonic stage comprises one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. However, it will be appreciated that nozzle 112 may be connected to the cyclone unit or dirt collection chamber at alternate locations.

Figure 6:
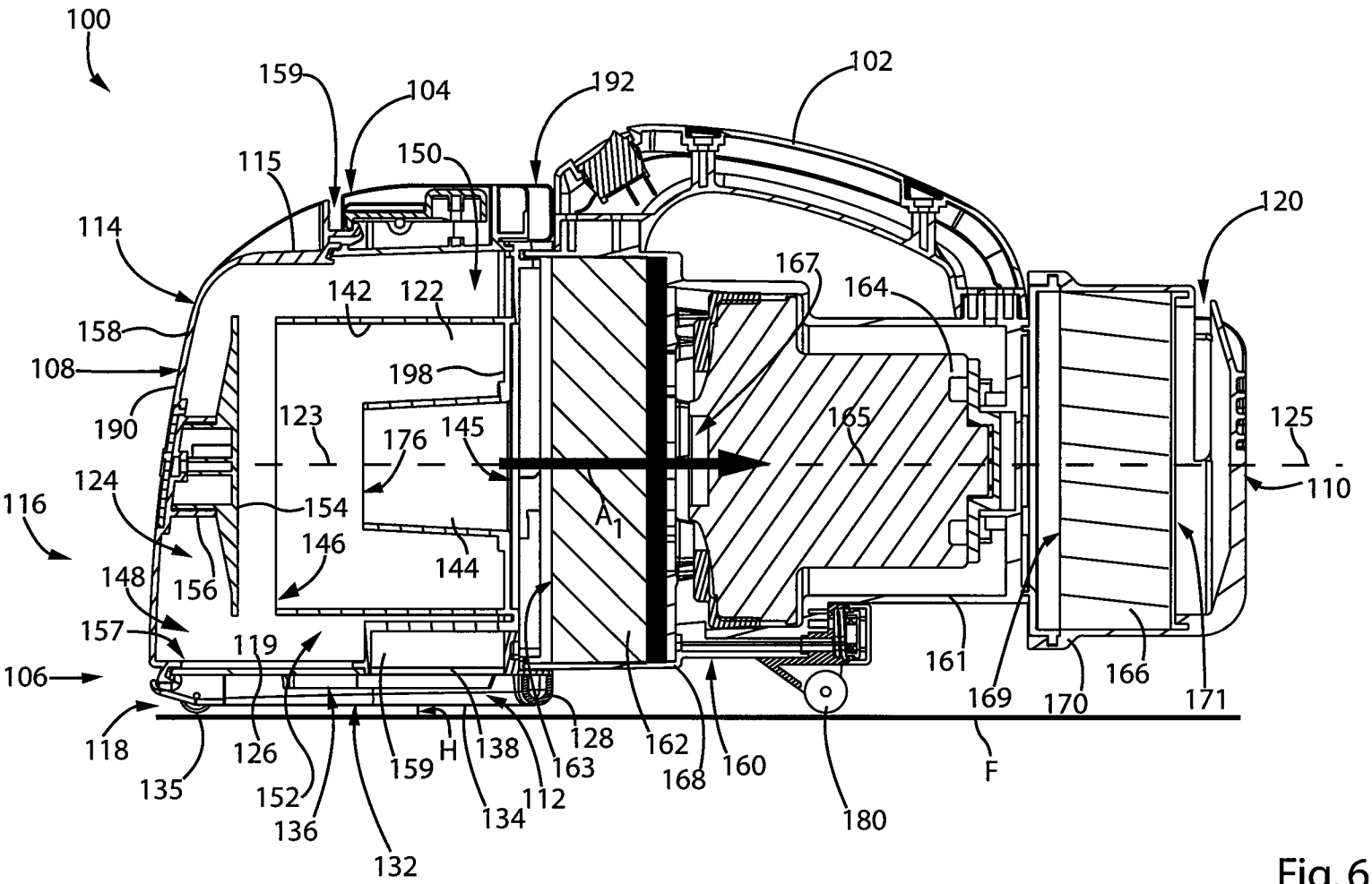
FIG. 6 is a cross section taken along line 6-6 in FIG. 2.
Figure 7:
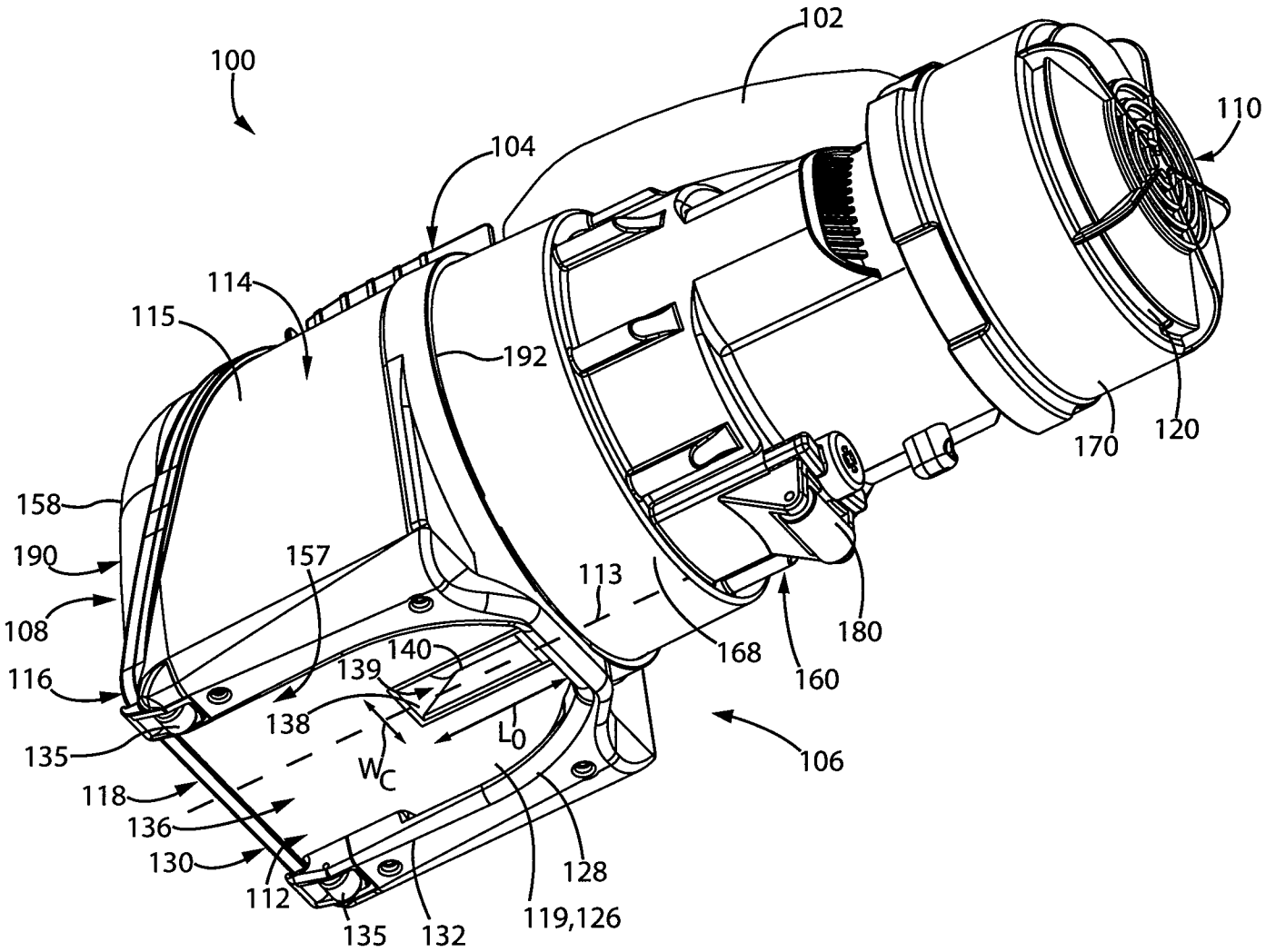
FIG. 7 is a bottom perspective view of the surface cleaning unit of FIG. 1.

Preferably, as exemplified, nozzle 112 may be on lower surface 157 of cyclone unit 114 and may share a wall with the cyclone unit 114. For example, in a particularly preferred design, the upper wall 126 of the nozzle 112 may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
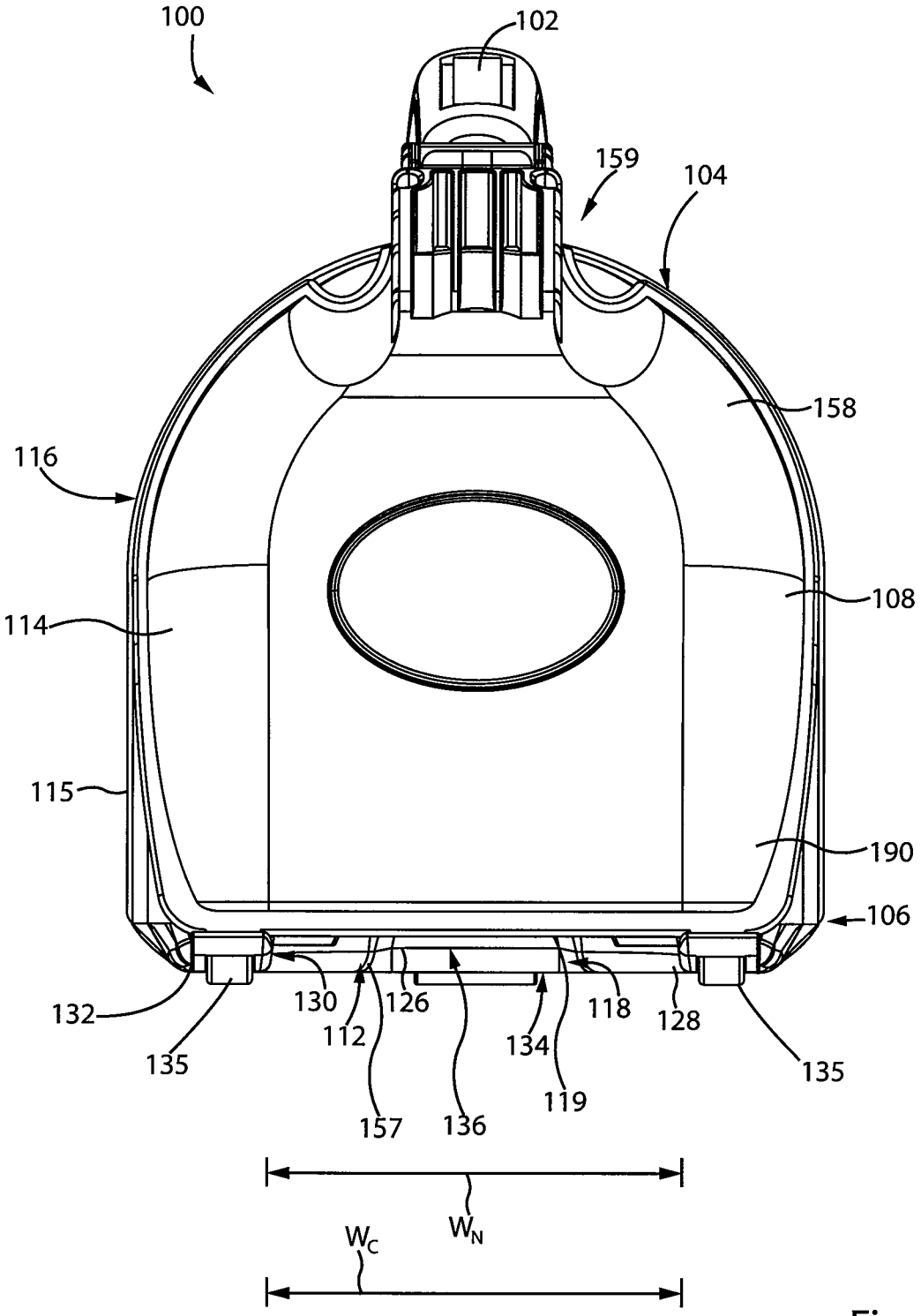
FIG. 3 is a front plan view of the surface cleaning unit of FIG. 1.
Figure 4:
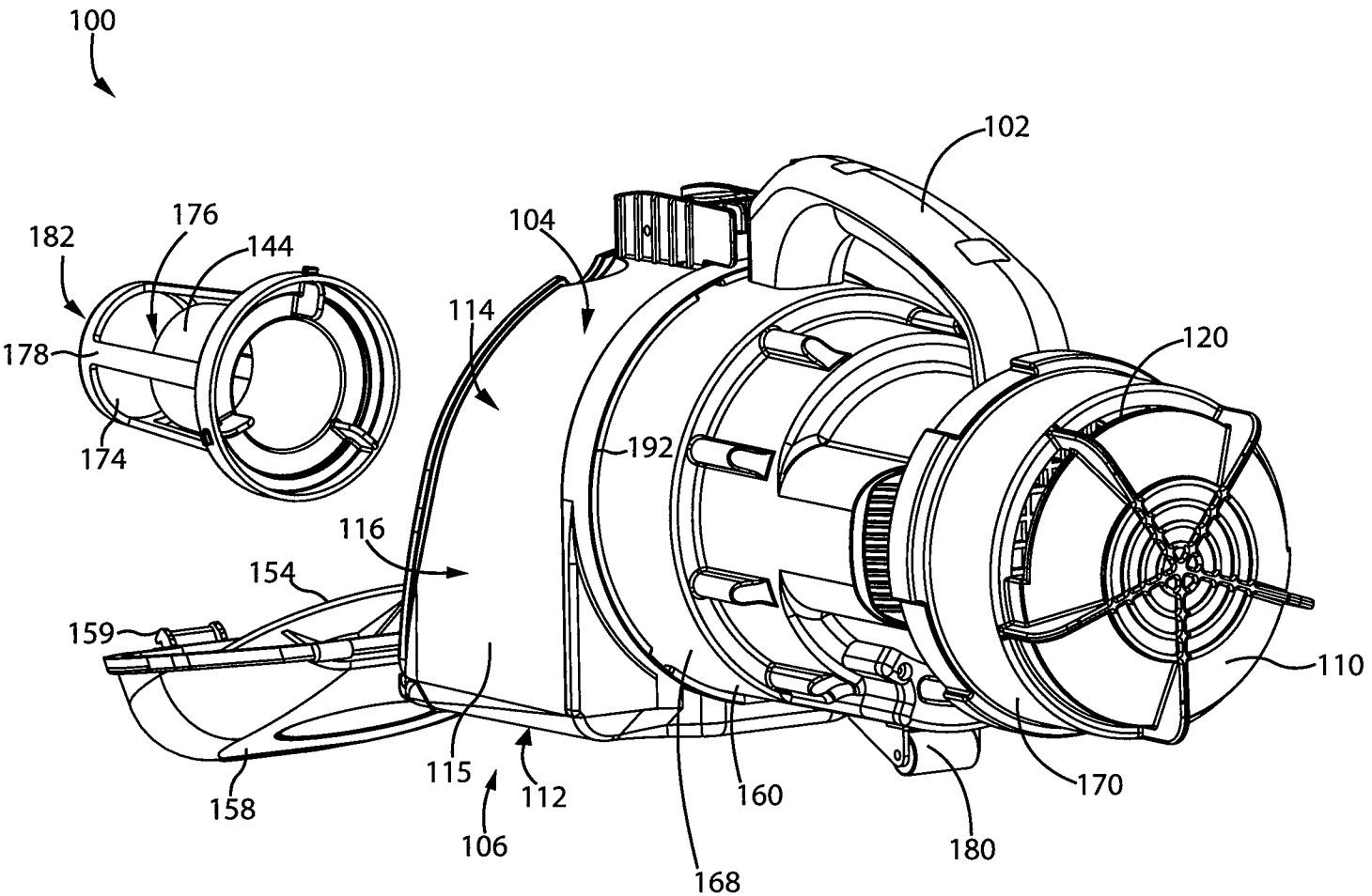
FIG. 4 is a partially exploded rear perspective view of the surface cleaning unit of FIG. 1.
Figure 5:
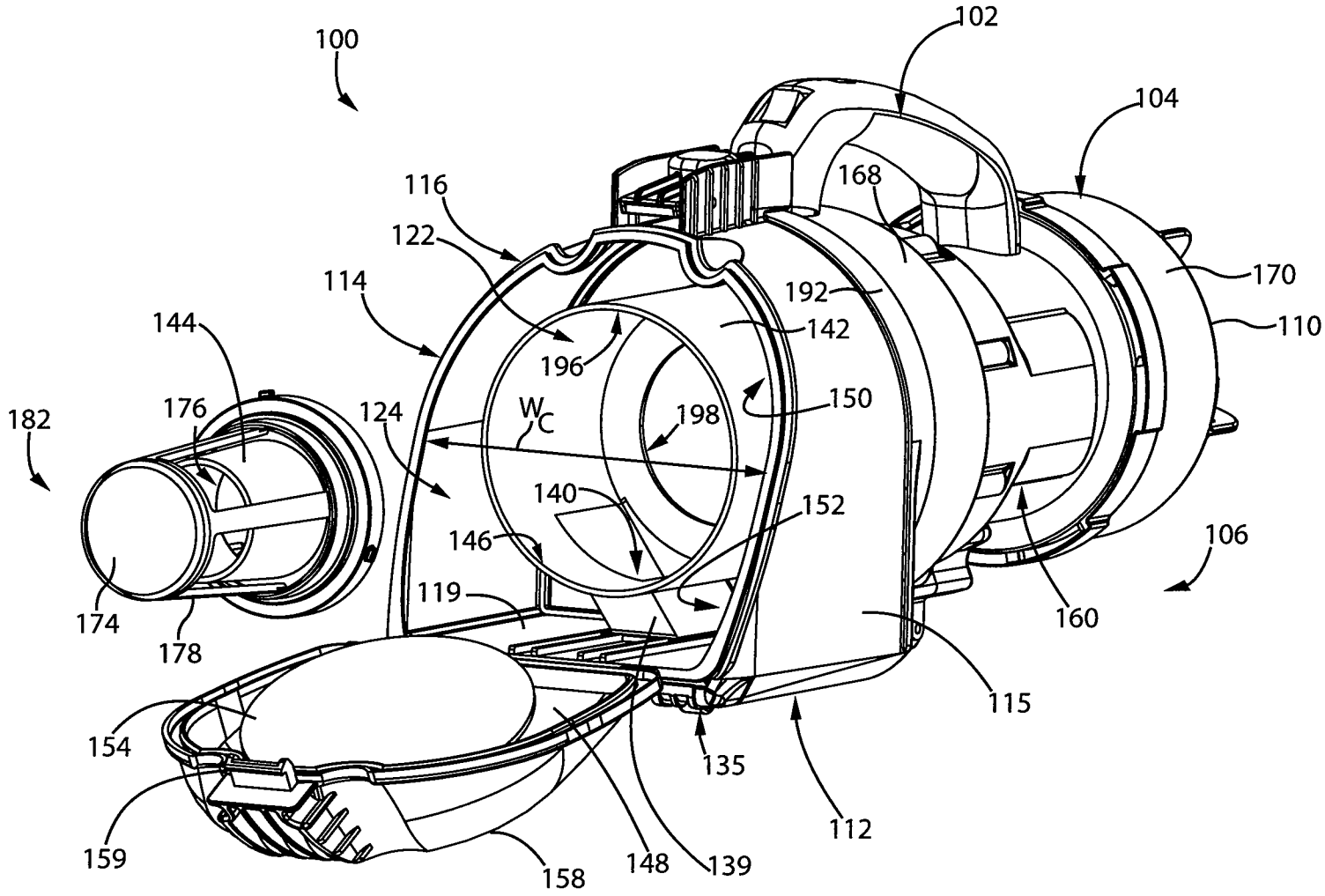
FIG. 5 is a partially exploded front perspective view of the surface cleaning unit of FIG. 1.

As shown in FIGS. 3 and 5, nozzle 112 has a width $W_N$, and cyclone unit 114 has a width $W_C$. In the example shown, $W_N$, and $W_C$ are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface 134 of the chamber is open. In an alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 may be mounted or provided on cyclone unit 114 and as exemplified on a lower portion of the dirt collection chamber so as to be removable with the dirt collection chamber An open sided design is exemplified in FIG. 7A wherein nozzle 112 comprises an upper nozzle wall 126. In the example shown, the upper nozzle wall 126 comprises a portion 119 of a wall 115 of the cyclone unit.

Preferably, one or more depending walls 128 extend downwardly from the upper nozzle wall 126. The depending wall is preferably generally U-shaped. In one embodiment, a depending wall 128 is provided rearward of opening 138. In other embodiments, depending walls may alternately or in addition be provided on the lateral sides of opening 138. It is preferred that the depending walls may be continuous to define a single wall as shown, or may be discontinuous. The depending walls may be provided on each lateral side of opening 138 and rearward thereof. Further, depending walls 128 may extend a substantial distance to the front end 108 and, preferably, essentially all the way to front end 108. The depending wall 128 may be continuous to define a single wall as shown, or may be discontinuous. The depending wall is preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 inches to 0.175 inches, more preferably from 0.04 to 0.08 inches.

The height of the depending wall 128 (between upper nozzle wall 126 and lower end 132) may vary. In some examples, the depending wall may have a height of between about 0.05 and about 0.875 inches, preferably between about 0.125 and about 0.6 inches and more preferably between about 0.2 and about 0.4 inches. The height of depending wall 128 may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F). As mentioned hereinabove, preferably, lower end 132 of depending walls 128 is spaced above floor F. Accordingly, some air may enter nozzle 114 by passing underneath depending wall 132. In such a case, the primary air entry to nozzle 114 is via open side 130 so that dirty air inlet 118 is the primary air inlet, with a secondary air inlet being under depending wall 128.

In the example shown, the lower end 132 of the depending wall 128 defines an open lower end 134 of the nozzle 114. The open lower end 134 preferably extends to the front 108 of the cleaner 100, and merges with the open side 130. In use, the exemplified nozzle 112 has an open lower end 134 that faces a surface to be cleaned.

In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from the surface to be cleaned, and the space between the lower end of the depending wall 128 and the surface to be cleaned form the secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 are provided. Preferably, the wheels are located adjacent front 108. Optionally, one or more rear wheels 180 may be provided. In an alternate embodiment, no wheels may be provided.

The upper nozzle wall 126, depending wall 128, and open lower end 134 of the nozzle 112 define open sided airflow chamber 136 of the nozzle. In use, when wheels 135 are in contact with a horizontal surface, the nozzle 112 and the airflow chamber 136 preferably extend generally horizontally, and preferably linearly along a nozzle axis 113 (see FIG. 7).

An opening 138 maybe provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with a cyclone inlet 140 of cyclone 122.

As exemplified in FIGS. 1-7, a single cyclone is used. As exemplified therein, the direction of air exiting the outlet of cyclone 122 is the same as the direction of airflow immediately upstream of the suction motor 164. Further, while an optional pre-filter 162 is positioned between the cyclone air outlet 145 and the suction motor 162, the front and rear face of the pre-motor filter are each preferably transverse to the direction of airflow leaving the cyclone outlet 145. Further, the direction of airflow through the pre-motor filter 162 is preferably in the same direction as the air leaving the cyclone outlet 145. Accordingly, in this preferred embodiment, while the air may spread out or converge as it travels through the pre-motor filter 162, some and preferably all of the air continues to generally travel in the same direction, namely rearwardly.

It will be appreciated that cyclone 122 may of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and/or preferably parallel to the cleaner axis 125. Axis 123 preferably extends generally horizontally when cleaner 100 is in use and wheels 135 are seated on a surface. Cyclone 122 has a front end 196, and a rear end 198. In the example shown, the front end 196 of the cyclone 122 is proximate the front end 108 of the vacuum cleaner 100.

Preferably, the cyclone air inlet 140 and the cyclone air outlet 145 are at the same end of the cyclone 122 and the dirt outlet 146 is at an opposed end. The cyclone air outlet 145 may be covered by a screen or shroud or filter as is known in the art. As exemplified, the cyclone air inlet 140 is defined by an aperture in the chamber wall 142. The cyclone inlet 140 is preferably at the rear end 198 of the cyclone 122. As can be seen in FIG. 5, the inlet passage 139 is configured such that air enters the cyclone 122 in a tangential flow path, e.g., passage 139 may be arcuate. The air travels in a cyclonic path in the cyclone 122, and dirt in the air is separated from the air. The air exits the cyclone via an outlet passage 144, through outlet 145. Outlet 145 is preferably at the rear end 198 of the cyclone. Accordingly, inlet 140 and outlet 145 are at the same end of the cyclone.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt outlet is preferably at the front 196 of the cyclone 122, and further, is at the front end 108 of the cleaner 100. The dirt collection chamber 124 may be internal or external to the cyclone chamber. Preferably, as exemplified, the dirt collection chamber is external. The dirt collection chamber 124 may be in communication with the cyclone chamber 122 by any means known in the art. Accordingly, one or more dirt outlets may be provided. Preferably, the dirt outlet is at the end opposed to the air inlet and, preferably, the dirt outlet is at the front end 108.

In the example shown, dirt collection chamber 124 preferably comprises two portions. A first portion 148 is provided immediately adjacent the dirt outlet 146, and is at the front end 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, and may be mounted in facing relation to the dirt outlet 146. The separation plate 154 aids in preventing dirt in dirt chamber 124 from re-entering cyclone 122. Preferably, plate 154 is spaced from dirt outlet 146. Plate 154 may be mounted by any means to any component in cyclone unit 114. As exemplified, the separation plate may be mounted on an arm 156, which extends from a front wall 158 at the front end 190 of the cyclone unit 114.

Cyclone unit 114 may be emptied by any means known in the art. For example, one of the ends of the cyclone unit 114 may be openable and/or removable. The end may open cyclone chamber as well as the dirt collection chamber. As exemplified in FIGS. 4 and 5, front wall 158 is pivotally mounted to the cyclone unit wall 115, and provides an openable door of the cyclone unit 114. Accordingly, cyclone unit 114 may be opened, and dirt chamber 124 may be emptied. The dirt collection chamber 124 is preferably openable both when the dirt collection chamber 124 is mounted to the hand vacuum cleaner, or when it is optionally removed, as will be described hereinbelow. If a plate 124 is provided on the front wall, then when front wall 158 is pivoted away from the remainder of the cyclone unit 114, separation plate 154 and arm 156 also pivot away from the remainder of the cyclone unit. A latch 159 or other securing member or members may be provided, which secure front wall 158 to wall 115. In alternate examples, front wall 158 may be removable from cyclone unit wall 115, or the rear wall 179 of the cyclone unit 114 may be openable or removable. In an alternate embodiment, only the dirt chamber may be removable.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is downstream of the surface cleaning head 116, and positioned rearward of the surface cleaning head 116. The cleaner body comprises a suction motor housing 168, which houses an optional pre-motor filter 162, a suction motor 164 and may house an optional post-motor filter 166. As can be seen in FIG. 6, the air flow passage includes a generally linear airflow path (indicated by arrow A1) between outlet 145 and suction motor 164. That is, the air flow passage does not comprise significant bends between outlet 145 and suction motor 164.

In the example shown, suction motor housing 168 further houses a pre-motor filter 162. One or more filters may be used. Pre-motor filter 162 is provided in the airflow path preferably adjacent and downstream of the outlet passage 144, and preferably facing the outlet 145. Pre-motor filter 162 has an inlet 163, and an outlet 167. Pre-motor filter 162 serves to remove remaining particulate matter from air exiting the cyclone 122, and may be any type of filter, such as a foam filter. As can be seen in FIG. 6, the cyclone unit 114, the pre motor filter 162, and the suction motor 164 are arranged linearly.

Suction motor 164 is provided in the airflow path adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165, which is generally parallel to the axis of rotation of a suction fan (not shown) of the suction motor. In the example shown, the motor axis 165 and the cyclone axis 123 extend in the same direction and are generally parallel. Further, in the example shown, the inlet 163 and the outlet 167 of the pre-motor 162 filter are generally transverse to the motor axis 165. That is, the inlet 163 and the outlet 167 of the pre-motor filter 162 are defined in planes that are transverse to the motor axis 165.

The cleaner body 160 preferably further comprises a post-motor filter housing 170. A post motor filter 166 is provided in the post-motor filter housing 170. The post motor filter 166 is provided in the airflow path downstream of, and preferably adjacent, the suction motor 164. The post-motor filter comprises an inlet 169 and an outlet 171. Outlet 171 is at the rear 110 of cleaner 100. In the example shown, the plane of the inlet 169 and, preferably in addition, the plane of the outlet 171 are generally transverse to the motor axis 165. Accordingly, the pre-motor filter air inlet 163, the pre-motor filter air outlet 167, the post motor filter air inlet 169 and optionally the post motor filter air outlet 171 are aligned. Post motor filter 166 serves to remove remaining particulate mater from air exiting the cleaner 100. Post-motor filter 166 may be any type of filter, such as a HEPA filter.

Clean air outlet 120 is provided downstream of post-motor filter 166. Clean air outlet 120 may comprise a plurality of apertures formed in housing 170.

In the example shown, cleaner body 160 is preferably removably mounted to surface cleaning head 116, such as by a bayounet mount, a screw mount or hand manipulateable mechanical fasteners. For example, cleaner body 160 may be entirely removable from surface cleaning head 116, or pivotally mounted to surface cleaning head 116. Accordingly, cleaner body 160 and surface cleaning head 116 may be separated in order to provide access to the interior of cleaner body 160 or surface cleaning head 116. This may allow pre-motor filter 162 to be cleaned, changed, or serviced, or motor 164 to be cleaned, changed or serviced. Alternately, surface cleaning head 116 may be cleaned or serviced. For example, any dirt stuck in outlet passage 144 may be removed. Alternately, a replacement cleaner body 160 or surface cleaning head 116 may be provided, and may be mounted to an existing surface cleaning head 116 or cleaner body 160, respectively.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Figure 8:
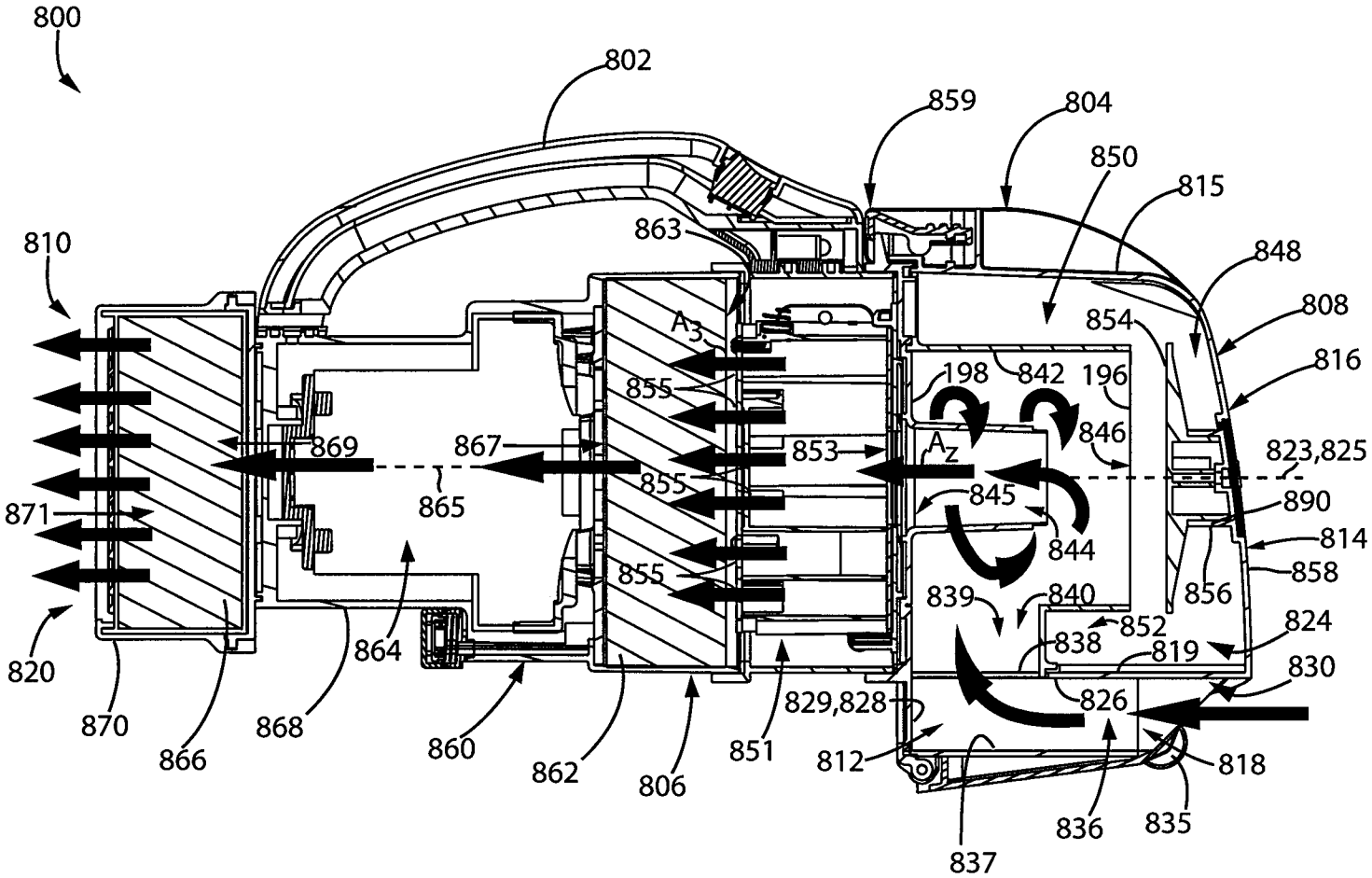
FIG. 8 is a cross section showing an alternate example of a surface cleaning unit.

Referring now to FIG. 8, in which like numerals refer to like features, with the first digit incremented to 8 to refer to the figure number, an alternate example of a hand vacuum cleaner 800 is shown. In this example, front wall 858 is not pivotally mounted to wall 815. Rather, wall surface cleaning head 816 is pivotally mounted to body 860.

Cleaner 800 further comprises a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823. Second cyclone unit 851 has an air inlet 853 and a plurality of air outlets 855. The direction of flow into the inlet 853 (indicated by arrow A2), and out of the outlets 855 (indicated by arrows A3) is the same as the direction of flow through the outlet 845 of the first cyclone unit 814 (also indicated by arrow A2).

Figure 9:
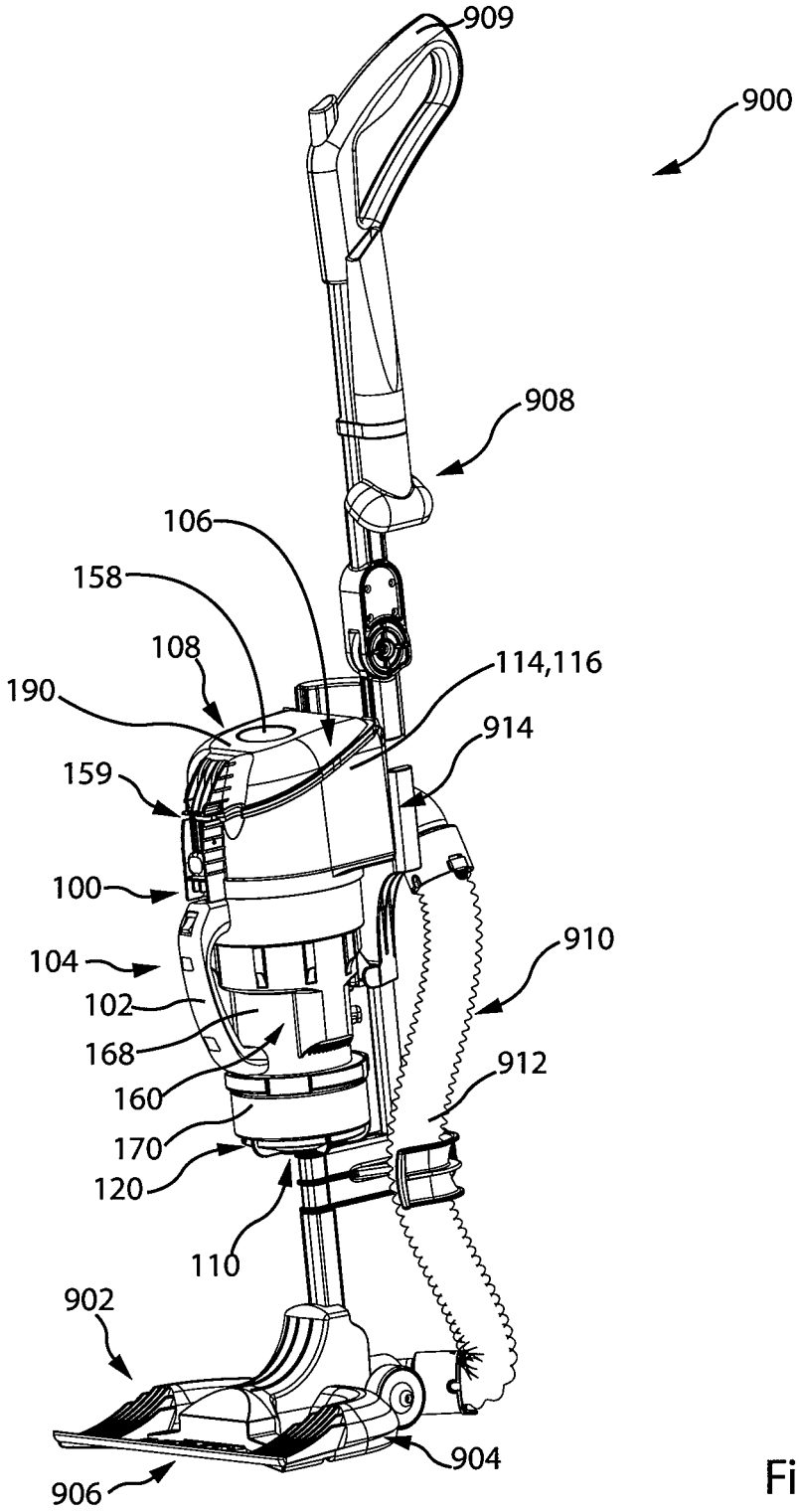
FIG. 9 is a perspective illustration of the surface cleaning unit of FIG. 1 mounted in a surface cleaning apparatus.
Figure 10:
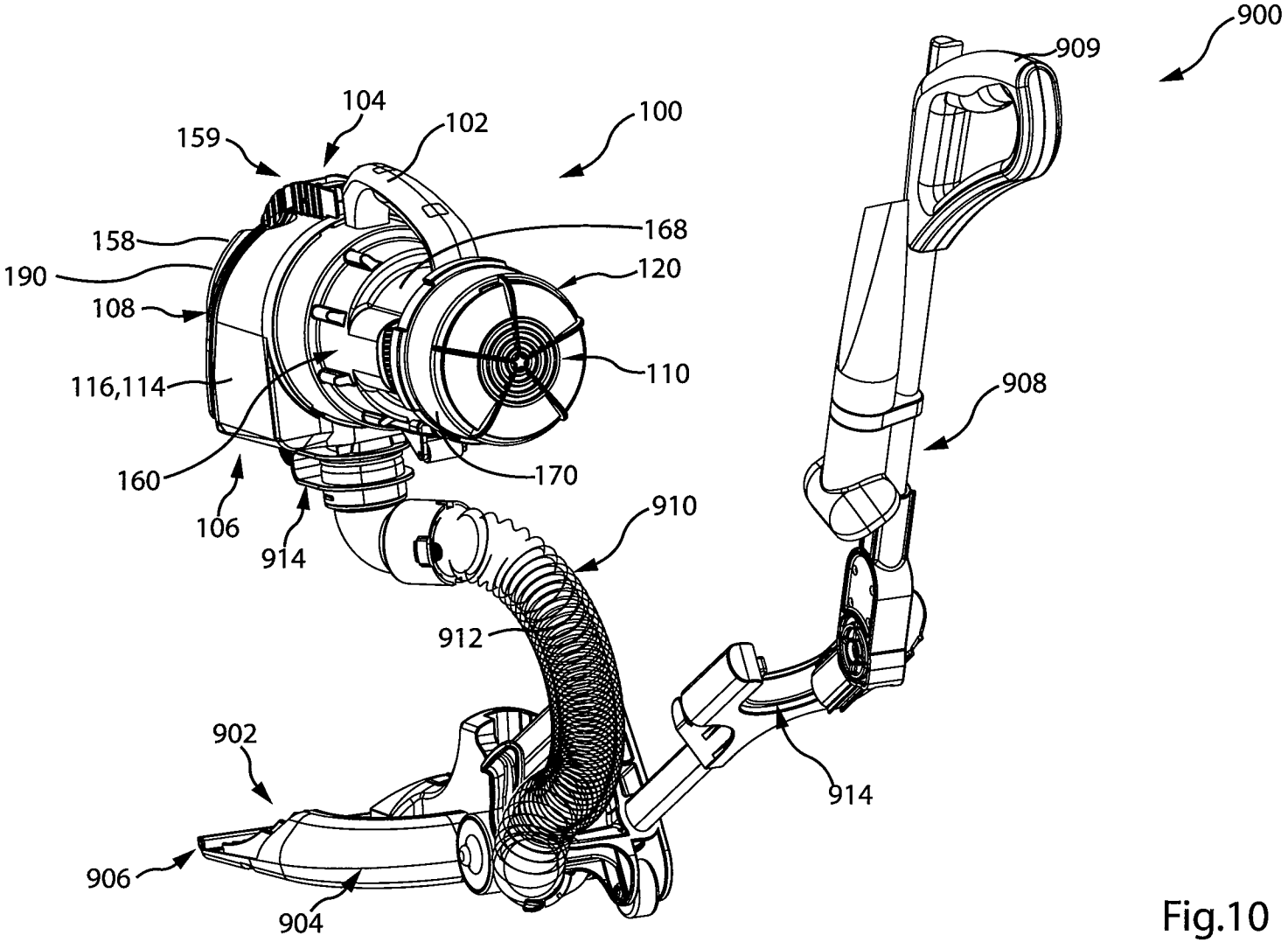
FIG. 10 is a perspective illustration of the surface cleaning unit of FIG. 1 in airflow communication with the surface cleaning apparatus of FIG. 9.

Referring now to FIGS. 9 and 10, in some embodiments, surface cleaning unit 100 is removably mountable in a surface cleaning apparatus. For example, surface cleaning unit 100 may be removably mounted to form a canister type surface cleaning apparatus, or, as shown, an upright surface cleaning apparatus 900. Preferably, as shown, surface cleaning unit 100 is usable as a hand vacuum cleaner, as described hereinabove, as well as being removably mountable in a surface cleaning apparatus. In alternate embodiments, surface cleaning unit 100 may be removably mounted in a surface cleaning apparatus, without being usable as a hand vacuum cleaner. For example surface cleaning unit 100 may not be provided with a surface cleaning nozzle 112, and may serve only as a removable pod of a surface cleaning apparatus.

In the embodiment shown, upright cleaning apparatus 900 comprises a floor cleaning unit 902, which comprises a surface cleaning head 904. The surface cleaning head comprises a dirty air inlet 906. A handle 908 is drivingly connected to the surface cleaning head 904, such that a user may grip the handle 908 and move the surface cleaning head 904 along a surface to be cleaned.

As exemplified, the surface cleaning unit 100 is connectable in airflow communication with the surface cleaning head 904. More particularly, the surface cleaning unit is connectable to the surface cleaning head 904 such that an airflow passage extends from the dirty air inlet 906 of the surface cleaning head to the clean air outlet 120 of the surface cleaning unit 100. For example, as shown, a portion 910 of the airflow passage extends between the surface cleaning head 904 and the surface cleaning unit 100. The portion 910 comprises a flexible conduit 912, which in the embodiment shown is hose. An attachment member 914 is provided, which connects the flexible conduit 912 to the cyclone unit 114 of the surface cleaning unit.

As exemplified, the surface cleaning unit 100 is removably mounted to and supported by handle 908, which extends upwardly from the floor cleaning unit 902 and comprises a handgrip 909. Preferably, handle 908 comprises a mount 914. In the embodiment shown, mount 914 comprises a U-shaped recess. The attachment member 914 is lockably receivable in the U-shaped recess, to mount the surface cleaning unit 100 to the handle 908 such that, the cyclone unit 114 and the suction motor 164 are supported by the handle 908.

In the exemplified embodiment, the attachment member 914 mounts the cyclone unit 114 to the handle 908. In alternate embodiments, any other portion of the surface cleaning unit 100, such as the motor housing 168, or the handle 102, may be mounted to the handle 908. Further, the portion may be mounted to the handle indirectly, such as via attachment member 914 as shown, or directly. For example handle 102 may be directly received in a mount provided on handle 908.

As can be seen in FIG. 9, preferably, when the surface cleaning unit 100 is mounted to the floor cleaning unit 902, the first cyclone unit 114 is positioned above the suction motor 164. That is, the suction motor 164 is below the cyclone unit 114. Accordingly, the front end 108 of the surface cleaning unit 100 becomes an upper end of the cyclone unit 114, and the openable door 158 is at the upper end of the cyclone unit 114. When the surface cleaning unit 100 is in this configuration, the linear airflow path between the first cyclone unit 114 and the suction motor 164 is generally vertical and flows generally downwardly.

Preferably, surface cleaning unit 100 is operable both when mounted to the floor cleaning unit 902, and when removed from the floor cleaning unit 902. That is, as shown in FIG. 10, the surface cleaning unit 100 may remain in fluid communication with floor cleaning unit 902, even when attachment member 914 is removed from mount 914. Accordingly, a user may hold handle 102 of surface cleaning unit 100 with a first hand, and hold handgrip 90 9 with a second hand. This may be useful in cleaning hard to reach locations, or small areas.

The invention claimed is:

1. An apparatus comprising:

(a) an air flow path extending from a dirty air inlet to a clean air outlet;

(b) a first cyclonic stage positioned in the air flow path, the first cyclonic stage comprising a cyclone chamber and a dirt collection chamber external to the cyclone chamber, the dirt collection chamber having an openable end wall, the cyclone chamber having a cyclone axis of rotation, a first end, an axially opposed second end, an air inlet provided at the first end of the cyclone chamber, an air outlet provided at the first end of the cyclone chamber and a dirt outlet provided at the second end of the cyclone chamber, wherein the second end of the cyclone chamber has an openable end wall which is mounted to and spaced axially inwardly from the openable end wall of the dirt collection chamber whereby the cyclone chamber and the dirt collection chamber are concurrently openable;

(c) a second cyclonic stage positioned in the air flow path downstream from the first cyclonic stage, the second cyclonic stage comprising a plurality of cyclones in parallel;

(d) a pre-motor filter chamber housing a pre-motor filter wherein, when the pre-motor filter is positioned in the pre-motor filter chamber, the pre-motor filter is positioned in the air flow path downstream of the second cyclonic stage; and, (e) a suction motor positioned in the air flow path downstream of the pre-motor filter, the suction motor having an axis of rotation wherein the suction motor axis of rotation extends through the pre-motor filter chamber and the second cyclonic stage.

2. The apparatus of claim 1 wherein the cyclone chamber has an axially extending sidewall and the dirt collection chamber has an axially extending sidewall that is spaced from and faces the sidewall of the cyclone chamber.

3. The apparatus of claim 1 wherein the cyclone chamber has a sidewall extending between the first and second ends of the cyclone chamber, the dirt collection chamber has a second end that is axially spaced from the openable end wall of the dirt collection chamber and the dirt collection chamber has a sidewall extending between the openable end wall and the second end wall of the dirt collection chamber wherein, a plane perpendicular to the cyclone axis of rotation passes through the sidewall of the cyclone chamber and the sidewall of the dirt collection chamber.

4. The apparatus of claim 1 wherein, in an in use position, the suction motor underlies the pre-motor filter chamber.

5. The apparatus of claim 4 wherein, in an in use position, the pre-motor filter chamber underlies the second cyclonic stage.

6. The apparatus of claim 1 wherein, in an in use position, the suction motor underlies the second cyclonic stage and the pre-motor filter chamber.

7. The apparatus of claim 1 wherein, the suction motor has an air inlet end that is positioned at an air outlet end of the pre-motor filter chamber.

8. An apparatus comprising:

(a) an air flow path extending from a dirty air inlet to a clean air outlet;

(b) a first cyclonic stage positioned in the air flow path, the first cyclonic stage comprising a cyclone chamber and a dirt collection chamber external to the cyclone chamber, the dirt collection chamber having an openable end wall, the cyclone chamber having a cyclone axis of rotation, a first end, an axially opposed second end, an air inlet provided at the first end of the cyclone chamber, an air outlet provided at the first end of the cyclone chamber and a dirt outlet provided at the second end of the cyclone chamber, wherein the second end of the cyclone chamber has an openable end wall which is mounted to and spaced axially inwardly from the openable end wall of the dirt collection chamber whereby the cyclone chamber and the dirt collection chamber are concurrently openable;

(c) a second cyclonic stage positioned in the air flow path downstream from the first cyclonic stage, the second cyclonic stage comprising a plurality of cyclones in parallel;

(d) a pre-motor filter chamber housing a pre-motor filter wherein, when the pre-motor filter is positioned in the pre-motor filter chamber, the pre-motor filter is positioned in the air flow path downstream of the second cyclonic stage; and, (e) a suction motor positioned in the air flow path downstream of the pre-motor filter, wherein, in an in use position, the suction motor underlies the second cyclonic stage and the pre-motor filter chamber.

9. The apparatus of claim 8 wherein, in an in use position, the pre-motor filter chamber underlies the second cyclonic stage.

10. The apparatus of claim 9 wherein, the suction motor has an air inlet end that is positioned at an air outlet end of the pre-motor filter chamber.

11. The apparatus of claim 8 wherein, the suction motor has an air inlet end that is positioned at an air outlet end of the pre-motor filter chamber.

12. The apparatus of claim 8 wherein, the suction motor has an axis of rotation wherein the suction motor axis of rotation extends through the pre-motor filter chamber and the second cyclonic stage.

13. The apparatus of claim 8 wherein the cyclone chamber has an axially extending sidewall and the dirt collection chamber has an axially extending sidewall that is spaced from and faces the sidewall of the cyclone chamber.

14. The apparatus of claim 8 wherein the cyclone chamber has a sidewall extending between the first and second ends of the cyclone chamber, the dirt collection chamber has a second end that is axially spaced from the openable end wall of the dirt collection chamber and the dirt collection chamber has a sidewall extending between the openable end wall and the second end wall of the dirt collection chamber wherein, a plane perpendicular to the cyclone axis of rotation passes through the sidewall of the cyclone chamber and the sidewall of the dirt collection chamber.

* * * * *